US005215223A

United States Patent [19]

Lee

[11] Patent Number: 5,215,223

[45] Date of Patent: Jun. 1, 1993

[54] SQUEEZING AND DISPENSING DEVICE

[76] Inventor: Sang Suk Lee, 72-9 Okum-Dong, Songpa-Ku, Seoul, Rep. of Korea

[21] Appl. No.: 832,899

[22] Filed: Feb. 10, 1992

[51] Int. Cl.[5] ..... B65D 35/34

[52] U.S. Cl. ..... 222/100; 222/410

[58] Field of Search ..... 222/99, 100, 105, 106, 222/410; 248/108, 109

[56] References Cited

U.S. PATENT DOCUMENTS

| | | | |
|---|---|---|---|
| 2,508,722 | 5/1950 | Loesser | 222/100 |
| 2,542,571 | 2/1951 | Rakestraw | 222/100 |
| 2,652,950 | 9/1953 | Major | 222/100 |
| 3,248,013 | 4/1966 | Bekhor | 222/100 |
| 3,473,698 | 10/1969 | Ballin | 222/100 |
| 3,885,708 | 5/1975 | Parry | 222/100 |
| 3,920,157 | 11/1975 | Yeung | 222/100 |
| 5,102,014 | 4/1992 | Yanagisawa et al. | 222/100 |

FOREIGN PATENT DOCUMENTS

| | | | |
|---|---|---|---|
| 203936 | 11/1958 | Switzerland | 222/100 |

*Primary Examiner*—Andres Kashnikow
*Assistant Examiner*—Philippe Derakshani
*Attorney, Agent, or Firm*—Birch, Stewart, Kolasch & Birch

[57] ABSTRACT

A squeezing and dispersing device comprising an lateral gear disposed along the end portion of a winding key and a gear holder for engaging in the teeth of the gear for progressively advancing the contents within the collapsible tube longitudinally along a usable portion thereof toward an opening provided through an one end of the tube. The flattened, spent portion of the collapsible tube is tightly wound to the winding key, which is arranged proximate the other end thereof, for easily removing the evacuated tube without unrolling of the tube from the top of the squeezing device.

8 Claims, 2 Drawing Sheets

SQUEEZING AND DISPENSING DEVICE

BACKGROUND OF THE INVENTION

1. Field of the Invention

The present invention relates to a squeezing and dispensing device for progressively advancing the contents along the inside of a collapsible tube such as a toothpaste tube. More particularly, the present invention relates to a squeezing device which includes a winding key having an annular gear disposed along the end portion thereof and a gear holder for engaging the teeth of the gear for preventing the collapsible rolled tube from releasing from the winding key.

2. Description of the Prior Art

Many of the prior art squeezing and dispensing devices for progressively advancing a collapsible tube are very complicated and not practical, thereby rending them unacceptable for commercial applicability or availability. Such squeezing devices are shown in U.S. Pat. Nos. 2,652,950 to Major, 3,473,698 to Ballin, 3,920,157 to Yeung, and 3,885,708 to Parry.

SUMMARY OF THE INVENTION

Accordingly, it is an object of the present invention to provide a squeezing device for progressively advancing a collapsible tube such as a toothpaste tube.

Another object of the present invention is to provide an improved squeezing device for use in a collapsible tube which includes a gear disposed at the end portion of a winding key and a gear holder for engaging the teeth of the gear whereby the collapsible tube can be tightly rolled with the winding key.

A further object of the present invention is to provide a squeezing device for progressively advancing the contents of a collapsible tube which is structured with a releasing member to release a gear holder whereby the collapsible tube can be easily removed from the squeezing device and winding key.

Still another object of the present invention is to provide a squeezing and dispensing device capable of dispensing a practical maximum quantity of contents of a collapsible tube such as a toothpaste tube.

Yet another object of the present invention is to provide a squeezing device which comprises a housing and a winding key which are both provided with slots which open at the end portions thereof for easily removing the rolled tube without unrolling of the tube from the squeezing device and the winding key.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention provides a squeezing and dispersing device comprising an lateral gear disposed along the end portions of a winding key and a gear holder for engaging in the teeth of the gear for progressively advancing the contents within the collapsible tube longitudinally along a usable portion thereof toward an opening provided through an one end of the tube. The flattened, spent portion of the collapsible tube is tightly wound to the winding key, which is arranged proximate the other end thereof, for easily removing the evacuated tube without unrolling of the tube from the top of the squeezing device.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
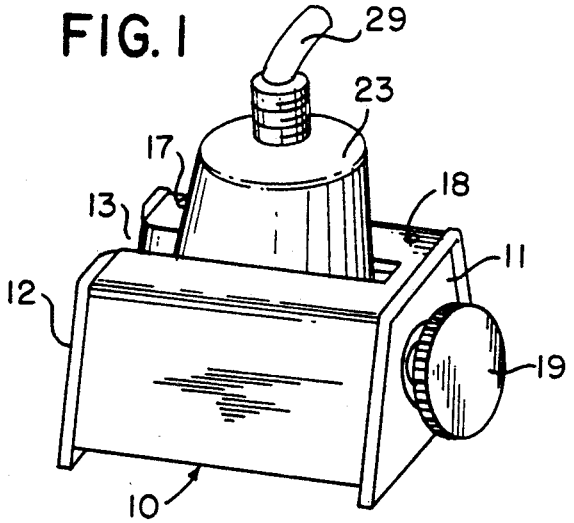
FIG. 1 is a perspective view of the squeezing and dispensing device of the present invention showing the device in association with a collapsible tube such as a toothpaste tube wherein the contents of the tube such as a toothpaste is disposed through an opening in the toothpaste tube.
Figure 2:
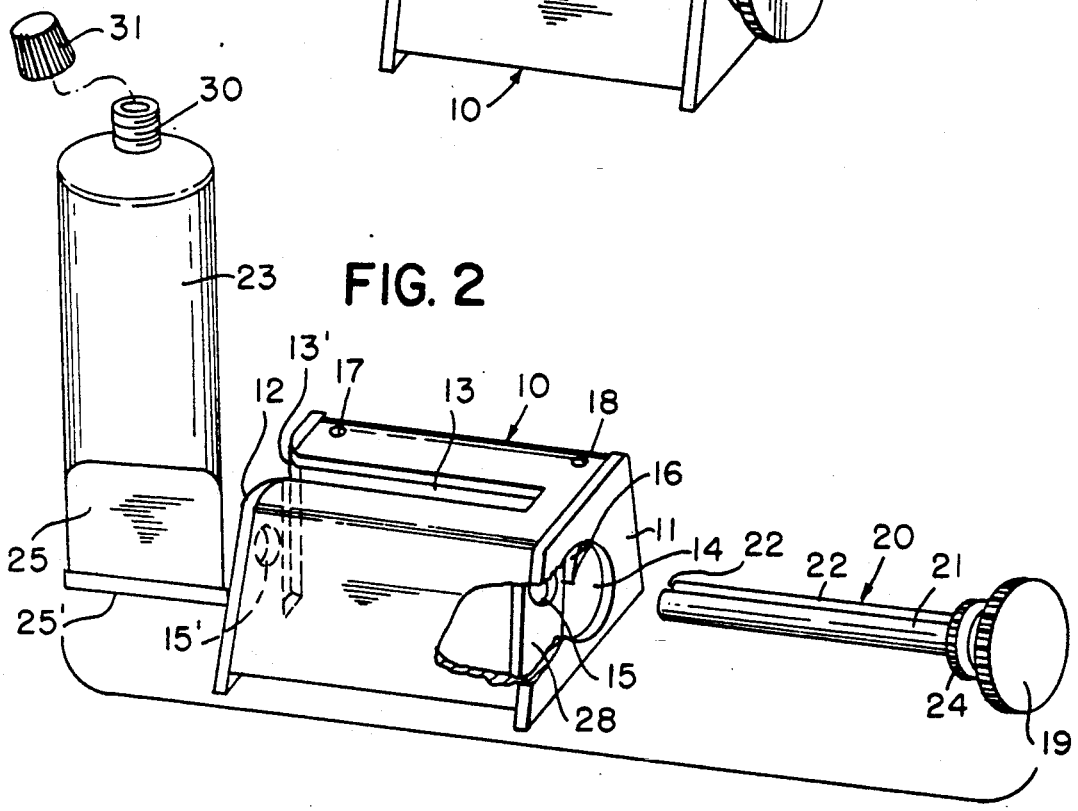
FIG. 2 is a perspective view of the basic components of the squeezing device illustrating a collapsible tube such as a toothpaste tube in a position to be introduced into the squeezing device.
Figure 7:
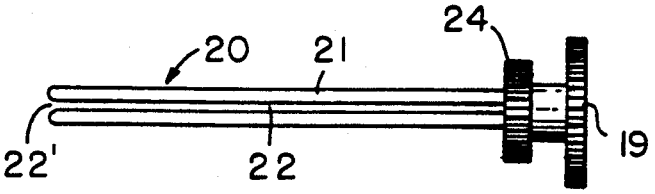
FIG. 7 is a top plan view of the winding key of the present invention.

Referring now in detail to the drawings for the purpose of illustrating preferred embodiments of the present invention, the squeezing and dispensing device as shown in FIGS. 1 and 2 comprises a trapezoidal shaped housing 10 having a housing slot 13 disposed at the top surface thereof, a winding key 20 having a shaft 21 which include a key slot 22 disposed therein, and a gear holder 16 disposed within the housing 10. The housing 10 is provided with a left side wall 11 having a large aperture 14 for receiving an annular gear 24 which is disposed at the end portion of the winding key 20. The right side wall 12 has a small aperture 15' for receiving the other end portion of the winding key 20. Also, the housing 10 is provided with a supporting member 28 which sits on the bottom surface of the housing 10 for receiving the shaft 21 therethrough. The winding key 20 is provided with a threaded handle 19 disposed at the one end thereof for winding a spent portion 25 of the toothpaste tube 23. The key slot 22 extends along the shaft 21 to form an end opening 22' disposed at the opposite end portion to the threaded handle 19 of the shaft 21 of the winding key (FIG. 7). In operative position, the end opening 22' of the winding key 20 is located at the same side of a housing as the side opening 13' which extends from the housing slot 13.

Figure 5:
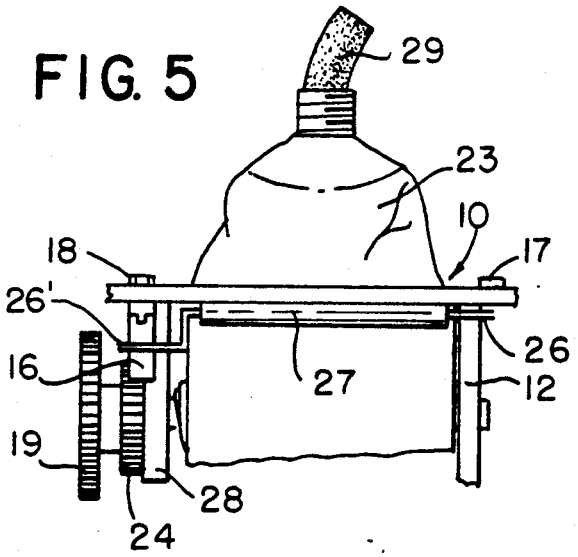
FIG. 5 is a side elevational view, partially in cross-section, of the components of FIG. 1 showing how the gear holder engages with the lateral gear.
Figure 6:
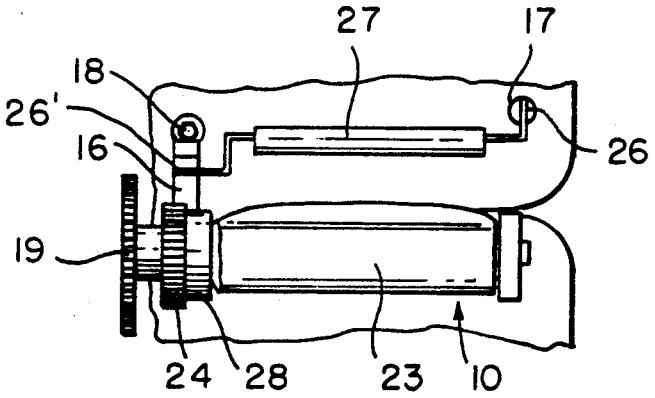
FIG. 6 is a bottom plan view, partially in cross-section, of the components of FIG. 1 showing how the gear releasing member is inoperatively associated with the gear holder.

A bent edge 16' of gear holder 16, made of a tensible material such as a stainless steel, is adapted to engage the teeth of the annular gear 24. One end portion of the gear holder 16 is attached to the interior top surface of the housing 10 through a bolt 18 and the other end portion 16″ is slidably attached by one end 26′ of a gear releasing member 26. The gear releasing member 26, which has a serpentine configuration, is inserted in a tubular rod 27 which is attached to the interior, top surface of the housing 10. The other end of the gear releasing member 26 connects to a push button 17 for releasing the gear holder 16 from the teeth of the annular gear 24 (FIGS. 5 and 6).

Figure 3:
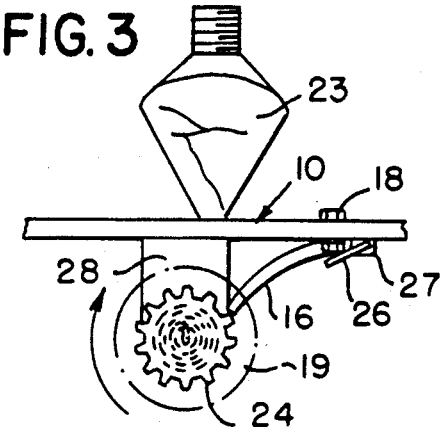
FIG. 3 is a side elevational view partially in cross-section, the tube of FIG. 1 showing in a tightly engaging position with the squeezing device.

In operation, as shown in the FIG. 3, the flattened, spent portion 25 of the toothpaste tube 23 is inserted into the housing slot 13 through the end opening 13′ of the housing 10. At this time, the edge 25′ of the flattened spent portion 25 is inserted into the key slot 22 through the end opening 22′ of the winding key 20. When the threaded handle 19 is rotated by hand in the direction indicated by the arrow, as shown in FIG. 3, the flattened, spent portion 25 is wound on the shaft 21 and the bending edge 16′ tightly engages into the teeth of the annular gear 24 due to the biased power of the steel gear holder 16.

Figure 4:
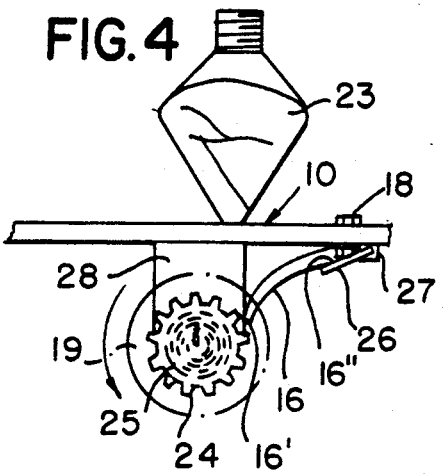
FIG. 4 is a side elevational view, partially in cross-section, showing the gear of the winding key in a released position.

When opening a cap 31 from the toothpaste tube 23, the toothpaste 29 is expelled from the toothpaste tube 23 through an aperture 30 (FIGS. 1, 2 and 3). To remove the rolled toothpaste tube from the squeezing and dispensing device 10, the push button 17 is first depressed. The end 26′ of the releasing member 26 automatically pushes the bending edge 16′ of the gear holder 16 for releasing the gear holder 16 from the annular gear 24 as shown in FIG. 4. Thus the empty toothpaste tube 23 can be easily removed from the housing 10 and the winding key 20 without unrolling of the tube.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A squeezing and dispensing device for progressively advancing the contents with a collapsible tube which comprises:

a housing having a housing slot disposed at the top surface thereof and extending along the side wall thereof, a winding key having a shaft provided with a lateral gear disposed at one end portion, said shaft containing a key slot which extends to the end of the shaft, said shaft being slidably disposed within said housing so that the slot in the side wall of the housing corresponds to the slot in the end of the shaft, a gear holder having a bending edge for engaging the teeth of said lateral gear, and a gear releasing member for engaging said g ear holder for releasing the gear holder from the annular gear, said releasing member engaging with a tubular rod which attaches to the interior of the top surface of said housing whereby the flattened, spent portion of the collapsible tube which has been tightly rolled around the shaft of the winding key is released and the spent tube is slidably removed through the side wall of the housing and the slit in the end of the shaft.

2. The squeezing and dispensing device of claim 1, wherein the collapsible tube is a toothpaste tube.

3. The squeezing and dispensing device of claim 1, wherein the housing has a trapezoid configuration.

4. The squeezing and dispensing device of claim 1, wherein the housing is provided with apertures disposed a side walls thereof for engaging the winding key.

5. The squeezing and dispensing device of claim 1, wherein the housing is provided with a supporting member having an aperture for engaging the shaft of the winding key therethrough.

6. The squeezing and dispensing device of claim 1, wherein the gear holder is made of steel.

7. The squeezing and dispensing device of claim 5, wherein one end of the gear holder extends away from the main portion thereof.

8. The squeezing and dispensing device of claim 1, wherein the releasing member has a serpentine configuration.

* * * * *